US007361831B2

(12) United States Patent
Tanaka et al.

(10) Patent No.: US 7,361,831 B2
(45) Date of Patent: Apr. 22, 2008

(54) COAXIAL CABLE AND MULTI-COAXIAL CABLE

(75) Inventors: Masato Tanaka, Yokohama (JP); Kiyonori Yokoi, Yokohama (JP); Kazuhiro Sato, Yokohama (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/502,626

(22) Filed: Aug. 11, 2006

(65) Prior Publication Data

US 2008/0035367 A1 Feb. 14, 2008

(51) Int. Cl.
*H01B 11/18* (2006.01)

(52) U.S. Cl. ..... 174/28

(58) Field of Classification Search ..... 174/28, 174/102 R, 113 C, 27
See application file for complete search history.

(56) References Cited

U.S. PATENT DOCUMENTS 3,248,473 A * 4/1966 Buhmann ..... 174/29
3,291,897 A * 12/1966 Bramley ..... 174/126.1
5,561,185 A 10/1996 Hashimoto et al.
6,812,401 B2 * 11/2004 Karrmann ..... 174/28
6,849,799 B2 * 2/2005 Springer et al. ..... 174/28
2006/0144613 A1 * 7/2006 Buck et al. ..... 174/113 R

FOREIGN PATENT DOCUMENTS

JP 05-012938 1/1993
JP 07-182930 7/1995
JP 11-144533 5/1999

* cited by examiner

*Primary Examiner*—Chau N. Nguyen
(74) *Attorney, Agent, or Firm*—Global IP Counselors, LLP

(57) ABSTRACT

A coaxial cable and multi-coaxial cable which comprise a low-permittivity insulator having an air layer, whose outer diameters can be reduced, which have excellent flexibility, and which allow productivity to be increased. In the coaxial cable, an electrically conductive filament body for forming an inner conductor, and a filling yarn made of an electrically insulating resin are twisted together, the outside of this twisted body is covered with a tubular insulator so that the insulator makes contact with the electrically conductive filament body and the filling yarn. An outer conductor is provided to the external periphery of the insulator. The multi-coaxial cable has a plurality of the coaxial cables, and the coaxial cables are covered with a common sheath composed of an insulating material.

9 Claims, 5 Drawing Sheets

COAXIAL CABLE AND MULTI-COAXIAL CABLE

BACKGROUND OF THE INVENTION

1. Field of the Invention

The present invention relates to a coaxial cable and a multi-coaxial cable that are suitable for use in devices having a display or imaging device, such as a notebook computer, mobile phone, ultrasound diagnostic device, endoscope, CCD camera, etc.

2. Background Art

A need has arisen in recent years for such devices to be reduced in size and weight, and for increased data transmission speeds and higher capacities to be achieved. In these devices, it is necessary to reduce the occurrence of electromagnetic interference (EMI) between signals. This interference is caused by the electromagnetic waves emitted from peripheral devices and signal lines through which high frequency signals are transmitted.

FIG. 5 is a perspective view showing one example of a conventional coaxial cable in a state in which a sheath of the distal end portion thereof has been removed. The conventional coaxial cable 1 has an inner conductor 2 in the center, an insulator 3 covering the conductor, a binding tape 3*a* being wound around the insulator 3, and an outer conductor 4 and a sheath 5 being disposed coaxially on the external periphery of the binding tape 3*a*. To achieve a reduction in the diameter of the coaxial cable 1, the insulator 3 is made thin. A fluorocarbon resin having a relatively low permittivity (dielectric constant) in comparison with other resins is preferably used for the insulator 3. In addition, in the conventional coaxial cable disclosed in Japanese Patent Application Laid-Open No. 11-144533, the fluorocarbon resin is foamed to create a large number of minute bubbles and to further reduce the permittivity of the insulator.

FIGS. 6A and 6B are schematic views showing another example of a conventional coaxial cable having a structure wherein a yarn is wound around an inner conductor. FIG. 6A is a cross-sectional view taken along a perpendicular plane to the axis of the cable, and FIG. 6B is a cross-sectional view taken along the axis of the cable. In the conventional coaxial cable 1', a yarn 7 composed of, for example, an insulating material such as PET is spirally wrapped around the external periphery of a central inner conductor 2', and an insulating tube 6 is extrusion-molded on, or tape is wrapped around, the external periphery of the yarn 7 to form a core portion. An outer conductor 4' is provided to the external periphery of the insulating tube 6 and the outer surface of the outer conductor is covered with a sheath 5' to ensure protection. This coaxial cable 1' is known to allow dielectric loss to be reduced by interposing an air layer 8 between the inner conductor 2' and the outer conductor 4' without filling the gap with an insulator (for example, see Japanese Patent Application Laid-Open No. 7-182930 (FIG. 3)).

When a foamed fluorocarbon resin is used as the insulator 3 of the conventional coaxial cable 1, a foamed fluorocarbon resin tape is wrapped around the outer surface of the inner conductor 2 to form the insulator 3. In this case, the adhesion between the insulator 3 and the inner conductor 2 is low, and the inner conductor 2 is prone to slip out from the insulator 3. Another problem is that the line speed for manufacturing cannot be made high. In addition, the conventional coaxial cable 1 also has low heat resistance, because adhesive-coated polyester tape, which is commonly used as the binding tape 3*a*, sometimes is contracted by heat, and the insulator 3 is sometimes exposed during the soldering process.

In the conventional coaxial cable 1', the insulating tube is extruded around the yarn 7 to form an insulator, and the line speed therefore can be increased. However, when the insulating resin cannot properly spreads on the yarn 7 and the insulating tube 6 is thinly formed, the insulating tube 6 readily breaks to form pinholes at a portion in which the tube makes contact with the yarn 7. Short-circuiting then readily occurs between the inner conductor 2' and the outer conductor 4'. In addition, the conventional coaxial cable 1', in which the inside diameter of the insulating tube 6 is equal to the sum of the outer diameter of the inner conductor 2' and twice the outer diameter of the yarn 7, has a disadvantage in terms of making the coaxial cable thinner.

SUMMARY OF THE INVENTION

An object of the present invention is to provide a coaxial cable and a multi-coaxial cable which comprise a low-permittivity insulator containing an air and have a small outer diameter and excellent flexibility and productivity.

In order to achieve this object, a coaxial cable is provided. In the cable, an electrically conductive filament body for forming an inner conductor and a filling yarn made of an electrically insulating resin are twisted together, a tubular insulator covers the outside of the twisted body so that the insulator makes contact with the electrically conductive filament body and the filling yarn, and an outer conductor is provided to the external periphery of the insulator. Additionally provided is a multi-coaxial cable which has a plurality of the coaxial cables of the present invention and in which the coaxial-cables are covered with a common sheath composed of an insulating material.

DETAILED DESCRIPTION OF THE PREFERRED EMBODIMENT

Figure 1A:
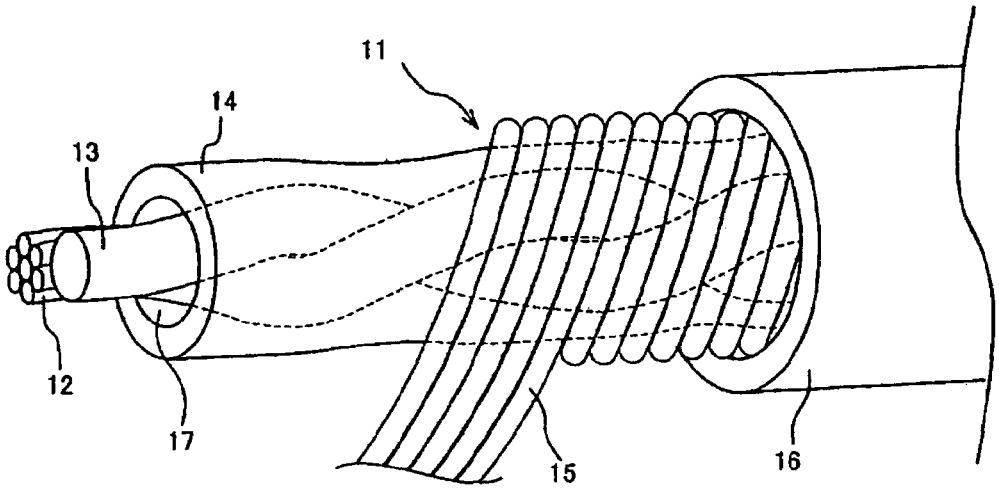
FIG. 1A is a perspective view of a coaxial cable according to an embodiment of the present invention, in a state in which the distal end portion of a sheath thereof has been removed.

Embodiments of the present invention are explained below by referring to the accompanying drawings. In the drawings, the same number refers to the same part to avoid duplicate explanation. The ratios of the dimensions in the drawings do not necessarily coincide with the explanation.

Figure 1B:
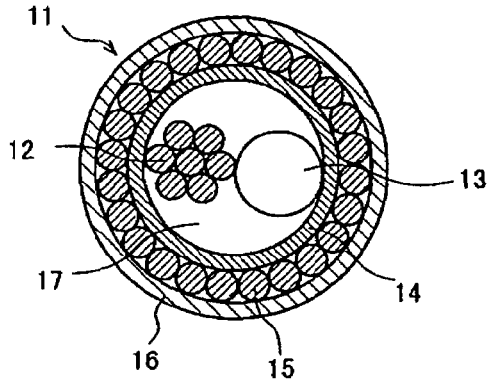
FIG. 1B is a cross sectional view of the cable illustrated in FIG. 1A taken along a plane perpendicular to a center axis of the coaxial cable.

FIGS. 1A and 1B are schematic views showing an embodiment of a coaxial cable according to the present invention. FIG. 1A is a perspective view of a state in which a sheath of the distal end portion has been removed, and FIG. 1B is a cross-sectional view taken along a plane perpendicular to the axis of the coaxial cable 11. In the coaxial cable 11, an electric filament body for forming an inner conductor 12, and a filling yarn 13 composed of an electrically insulating resin are twisted together, and the external periphery of the twisted body is covered with a tubular insulator 14 to form a core portion. An outer conductor 15 is placed coaxially on the external periphery of the insulator 14, and the outside of the conductor is covered with a sheath 16.

The inner conductor 12 is a single wire consisting of a copper wire, a copper alloy wire, or another electrically conductive filament body, or a stranded wire (for example, a stranded wire that has an outer diameter of 0.075 mm and is obtained by twisting together seven silver plating copper alloy wires, each having an outer diameter of 0.025 mm). The filling yarn 13 is formed from a fluorocarbon resin-based electrically insulating material and has about the same thickness as the inner conductor 12 (for example, an outer diameter of 0.075 mm). The inner conductor 12 and the filling yarn 13 are twisted together at a pitch of about 0.5 mm to about 10 mm.

The insulator 14 is formed by extrusion molding on the outside of the twisted body of the inner conductor 12 and the filling yarn 13 into a tube whose inside diameter is equal to the combined thickness of the inner conductor 12 and the filling yarn 13, and whose outer diameter is about 0.29 mm with a thickness of about 0.07 mm. The insulator 14 may have a cross-sectional shape other than that of a perfect circle, and may be oval as long as contact is established between the insulator 14 and both of the inner conductor 12 and the filling yarn 13 along the length of the insulator 14, as indicated in one arbitrary cross section depicted in FIG. 1B. An air layer 17, which has a low permittivity body, is formed between portions of the internal surface of the insulator 14 and portions of the inner conductor 12, as is also indicated in the cross-sectional view in FIG. 1B.

A copper wire, copper alloy wire, or another electrically conductive filament body is spirally wound or braided around the external periphery of the insulator 14 to form an outer conductor 15. For example, a silver-plating copper alloy wire having an outer diameter of 0.03 mm may be spirally wound to form the outer conductor 15. Two layers of polyester tape, for example, having a thickness of about 0.004 mm may be overlap-wrapped on the outer periphery of the outer conductor 15 and fused together to form a sheath 16. As a result, an ultra fine coaxial cable 11 having an outer diameter of about 0.38 mm is obtained.

A portion of the inner conductor 12 of the coaxial cable 11 is in contact with the insulator 14, and the insulation layer between the inner conductor 12 and the outer conductor 15 as a whole largely comprises the air layer 17. As a result, the permittivity of the insulation layer, which is a mean of the permittivities of the air layer 17, the filling yarn 13, and the insulator 14, is about 1.3, is less than the permittivity (2.1) of an insulation layer composed of solid fluorocarbon resin. It is thereby possible to obtain a coaxial cable whose dielectric loss (attenuation) is as low as that of a coaxial cable using a foamed insulating resin or the conventional coaxial cable 1'. Furthermore, because the insulator 14 is formed by extrusion molding, the line speed for manufacturing and productivity can be increased as compared with the conventional coaxial cables using foamed fluorocarbon resin insulating tape. In addition, the same effect that is attained with an expensive foamed fluorocarbon resin can be obtained in the coaxial cable 11 by using less-expensive materials such as above-mentioned polyester tape.

The inside diameter of the insulator can be made smaller in the coaxial cable 11 as compared with that of the conventional cable 1'. Furthermore, because the inner conductor 12 and the filling yarn 13 both contact with the internal surface of the tubular insulator 14 at locations that are opposite to one another, a cylindrical thin-walled molding for the insulator 14 can be created and the occurrence of pinholes can be reduced. In the structure of the conventional coaxial cable 1', the insulator comes into contact with the structural components (the yarn) inside the cable at only one location in the cross section perpendicular to the axis, and thus, the insulator tends to collapse at all other locations that are not contacting the structural components. It is believed that when the insulator collapses, the resin at the location where contact is made with the yarn flows into the surrounding areas and causes the resin to break and pinholes to form. In contrast, in the embodiment of the present invention, the insulator 14 comes into contact with the structural components (the inner conductor 12 and the filling yarn 13) at two locations in the cross section perpendicular to the axis of the cable 11. Therefore, the insulator 14 is less likely to collapse and the resin is less likely to break than in the conventional coaxial cable 1'. In the conventional coaxial cable 1', the thickness of the insulator must be increased in order to prevent pinholes from forming. However, in the embodiment of the present invention, the thickness of the insulator 14 can be made smaller than in the conventional coaxial cable 1' because pinholes are less likely to form. As a result, the coaxial cable 11 can be made as thin as a conventional coaxial cable formed by wrapping a foamed fluorocarbon resin tape.

Furthermore, because the inner conductor 12 and the filling yarn 13 are disposed within the insulator 14 in a twisted fashion, the inner conductor 12 is less likely to slip out. In addition, the heat resistance (about 250° C.) can be raised and resistance to soldering can be improved when the filling yarn 13 and the insulator 14 are both made of the same fluorocarbon resin material (for example, a tetrafluoroethylene/perfluoro alkyl vinyl ether copolymer (PFA)). The filling yarn 13 can be cut off at the same time as the insulator 14 by a laser-based terminal treatment, and workability is improved.

Figure 2A:
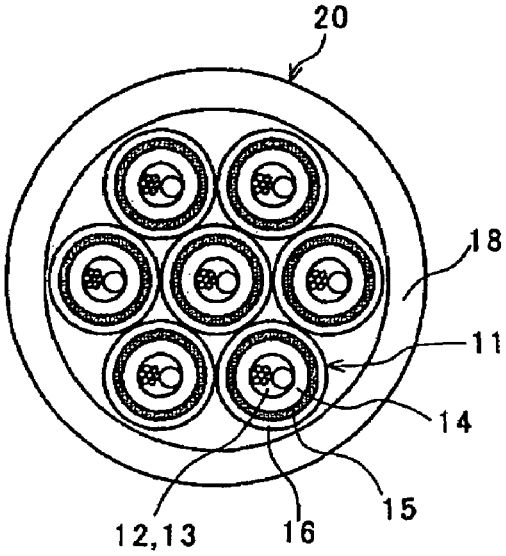
FIGS. 2A to 2D are schematic cross sectional views illustrating examples of a multi-coaxial cable including a plurality of the coaxial cables according to an embodiment of the present invention.

FIGS. 2A to 2D are schematic views showing examples of a multi-coaxial cable comprising a plurality of the coaxial cables of the present invention. A multi-coaxial cable 20 shown in FIG. 2A is an example wherein a plurality of coaxial cables 11 are provided in a bundled state and are gathered together by a common sheath 18. In the multi-coaxial cable 20, the coaxial cables 11 are each protected by the sheath 16. The multi-coaxial cable 20 can therefore be easily handled by having the coaxial cables 11 as separate elements when wired, the outer conductors 15 do not become loose, and handling is facilitated.

Figure 2B:
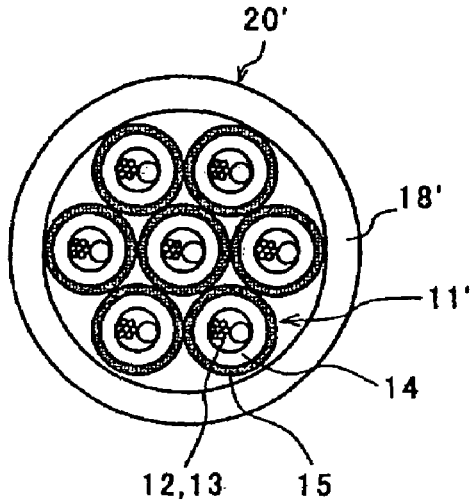

A multi-coaxial cable 20' shown in FIG. 2B is an example wherein a plurality of coaxial cables 11', which are identical to the coaxial cables 11 except for the sheaths 16 are not provided, are placed in a bundled state and are gathered together by a common sheath 18'. In the multi coaxial cable 20', the outer conductors 15 of the coaxial cables 11' come into contact with each other and are electrically interconnected. The outer conductors 15 can be made to have low resistance as a whole and the shield electrical potential difference can be kept small. The twisting performance of a multi-coaxial cable can be enhanced by gathering the coaxial cables into a bundled state as in the multi-coaxial cables 20, 20'.

Figure 2C:
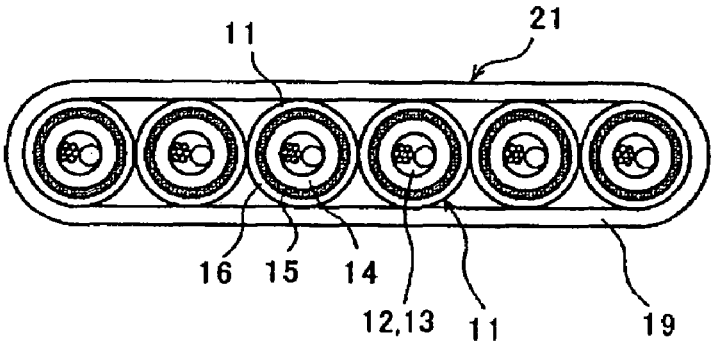
Figure 2D:
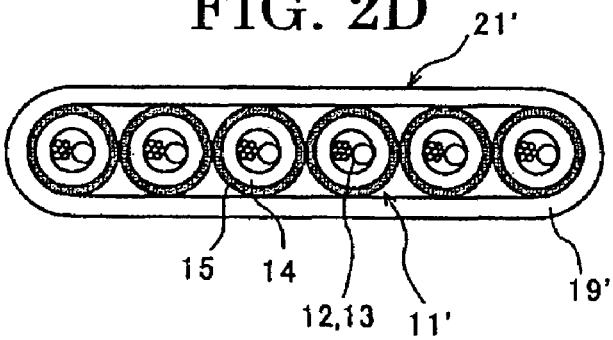

FIG. 2C shows an example of a multi-coaxial cable 21 wherein a plurality of the coaxial cables 11 having the sheaths 16 are aligned in a parallel row and flattened using a common sheath 19. FIG. 2D shows an example of a multi-coaxial cable 21' wherein a plurality of the coaxial cables 11' that do not have the sheaths 16 are aligned in a parallel row and flattened by a common sheath 19'. In the multi-coaxial cables 21, 21', the common sheaths 19, 19' may be an insulating tape for sheathing that is adhesively bonded to the upper and lower surfaces of the coaxial cables 11, 11' to form a cover.

The advantages of the coaxial cables 21, 21' include the ability to be used in the same manner as a flexible printed circuits (FPC) board by being flattened, particularly in wiring along a flat surface, and the ability to provide enhanced bending performance. Any of the multi-coaxial cables 20, 20', 21, and 21' can be shielded by the outer conductors 15 and can provide the desired impedance matching and EMI characteristics.

Figure 3A:
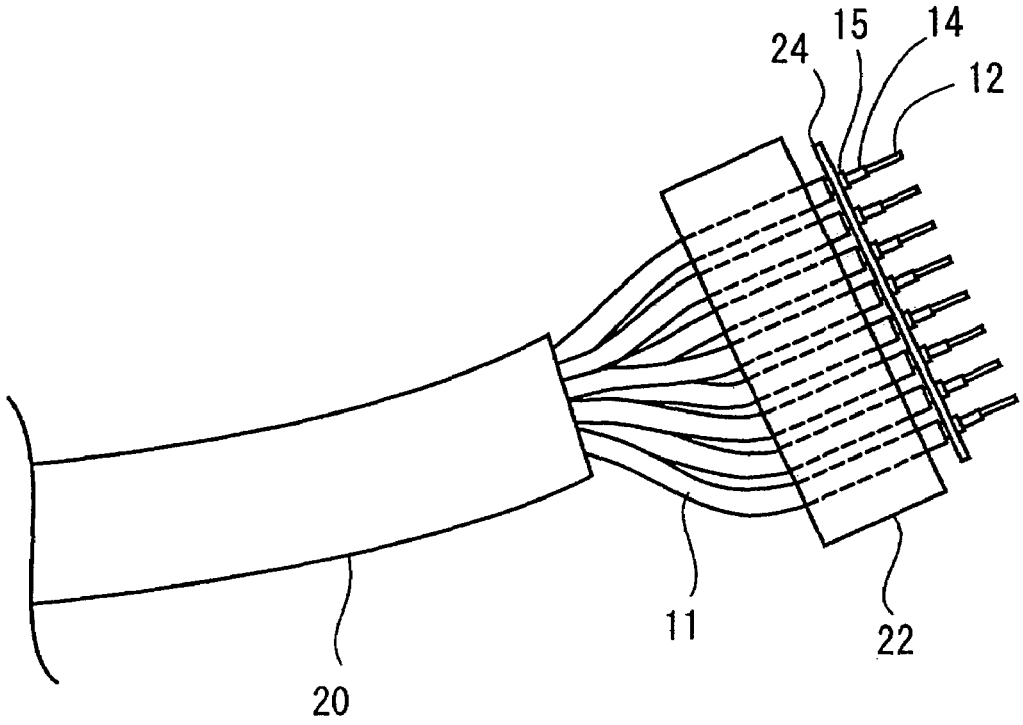
FIG. 3A is a schematic view of the bundled-type multi-coaxial cable according to an embodiment of the present invention, the cable having an electric connection terminal.
Figure 3B:
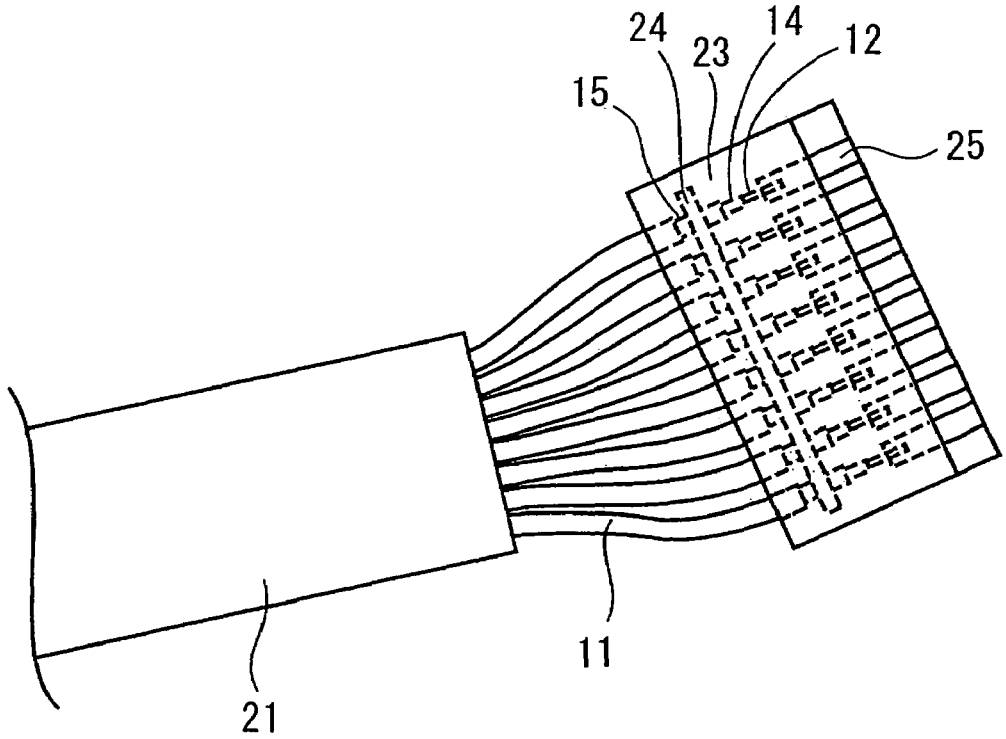
FIG. 3B is a schematic view of the flat-type multi-coaxial cable according to an embodiment of the present invention the cable having an electric connection terminal.

FIGS. 3A and 3B are diagrams showing examples wherein an electric connection terminal is formed on the multi-coaxial cable. FIG. 3A is a schematic view of a connection terminal that is arranged in a state wherein the end portions of the coaxial cables in the multi-coaxial cable 20 are formed to easily achieve an electric connection. The electric connection terminal shown in FIG. 3A is formed via the following steps. First, the bundled coaxial cables 11 are arranged in a plane at prescribed intervals, and adhesive tape 22 is attached to fix the coaxial cables 11 so as to maintain the intervals. Tape composed of polyester, fluorocarbon, or another resin can be used as the adhesive tape 22. Next, the sheaths are removed from the end portions of the coaxial cables 11, and the outer conductors 15 are exposed.

A ground bar 24 is then attached to the outer conductors 15 so as to be electrically connected. The bar may be, for example, soldered or bonded using an electrically conductive adhesive. The ends of the coaxial cables 11 are thereby arranged and kept together at prescribed intervals in a plane by the ground bar 24. Next, portions of the outer conductors 15 are left, and the outer conductors 15 further toward the end are removed to expose the insulators 14. Then, portions of the insulators 14 is left, and the insulators 14 further toward the end are removed to expose the inner conductors 12 and filling yarn 13. The filling yarn is cut and removed. The adhesive tape 22 may be peeled off if the electric connection terminals shown in FIG. 3A are further attached to a connector or a substrate.

FIG. 3A shows the electric connection terminal formed on a multi-coaxial cable 20 having the sheathed coaxial cables 11 bundled. The electric connection terminal may have the same construction even with the multi-coaxial cable 21 that has a multi-core flattened arrangement. The same type of electric connection terminal can be used in the multi-coaxial cables 20', 21' having the unsheathed coaxial cables 11' into a multi-core arrangement, in which case there is no need to remove the sheaths 16.

FIG. 3B is a schematic view of a connection terminal wherein a connecting means is added to the multi-coaxial cable 21. The electric connection terminal shown in FIG. 3B is formed via the following steps. The process is the same as that described in FIG. 3A until the outer conductors 15 and insulators 14 are removed in the stated order, the outer conductors 15, insulators 14, and inner conductors 12 are exposed in tiers, and the outer conductors 15 are electrically connected to the ground bar 24. The inner conductors 12 of the coaxial cables 11 are electrically connected to contacts 25 provided on the connector. This connection can be achieved by soldering or using an electrically conductive adhesive.

Next, the ground bar 24, the outer conductors 15, the insulators 14, the inner conductors 12, and part of the contacts 25 are covered by a connector id component. The outer conductors 15 are electrically connected to the grounding terminal of the connector at this time. If a metallic shell is used as the lid component, the shell can be used as the grounding terminal of the connector. In such cases, the ground bar 24 is electrically connected to the shell, and the shell is not electrically connected to the inner conductors 12. If the connector 23 is connected to a receptacle (not shown) on the side of the device, the contacts 25 are electrically connected to the signal circuit of the receptacle, and the ground bar 24 is electrically connected to the grounding circuit of the receptacle via the shell.

FIG. 3B shows the electric connection terminal of the multi-coaxial cable 21 wherein the sheathed coaxial cables 11 are formed into a multi-core flattened arrangement. The electric connection terminal with the multi-coaxial cable 20 that has a plurality of coaxial cables bundled may have the same construction. The same type of electric connection terminal can be used in the multi-coaxial cables 20', 21' having the unsheathed coaxial cables 11' into a multi-core arrangement, in which case there is no need to remove the sheaths 16 because the coaxial cables 11' are not sheathed. The connector usually has a plurality of contacts 25 arranged in a single row at a high density. It is preferable to use the multi-coaxial cables 21 or 21' wherein the coaxial cables 11 or 11' are arranged in a flattened state at as the same pitch as the contacts since the cables are easy to be connected with the connectors.

The product of the present invention (example), and a conventional product (comparative example) having the configurations shown in Table I were manufactured, and the electrical and mechanical characteristics were compared. Specifically, the foamed fluorocarbon resin tape used as the comparative example is a tape made of Poreflon® (registered trademark of Sumitomo Electric).

TABLE I

| Items | | Comparative Example | Example |
|---|---|---|---|
| Inner Conductor | Material | Silver Plating Copper Alloy Wire | Silver Plating Copper Alloy Wire |
| | Number of Element Wire/Element Wire Diameter (mm) | 7/0.025 | 7/0.025 |
| | Outer Diameter (mm) | 0.075 | 0.075 |
| Insulator | Material | Foamed Fluorocarbon Resin Tape + Polyester Tape | PFA (Filling Yarn) + PFA (Tube) |
| | Outer Diameter (mm) | 0.25 | 0.29 |
| Outer Conductor | Material | Tin Plating Copper Alloy Wire | Tin Plating Copper Alloy Wire |
| | Element Wire Diameter (mm)/Wrapping | 0.03/Spiral serve Shielding | 0.03/Spiral Serve Shielding |
| Sheath | Material | Polyester Tape | Polyester Tape |
| | Wrapping | Overlap Wrapping | Overlap Wrapping |
| | Outer Diameter (mm) | 0.34 | 0.38 |
| Resistance Ω/km | | 5800 | 5800 |
| Characteristic Impedance at 10 MHz Ω/km | | 80 | 80 |
| Attenuation at 10 MHz dB/km | | 430 | 430 |

A foamed fluorocarbon resin tape and a binding polyester tape were used as the insulator in the comparative example, and the total outer diameter of the insulator was 0.25 mm. In contrast, a PFA filling yarn and an extrusion-molded PFA resin were used in the product of the present invention, and the outer diameter of the insulator was 0.29 mm. These electrical characteristics were measured and it was found that both the conventional product and the product of the present invention had about the same characteristics, namely, a conductor resistance of 5800 Ω/km, a characteristic impedance of 80 Ω(10 MHz), and an attenuation of 430 dB/km (10 MHz).

Figure 4:
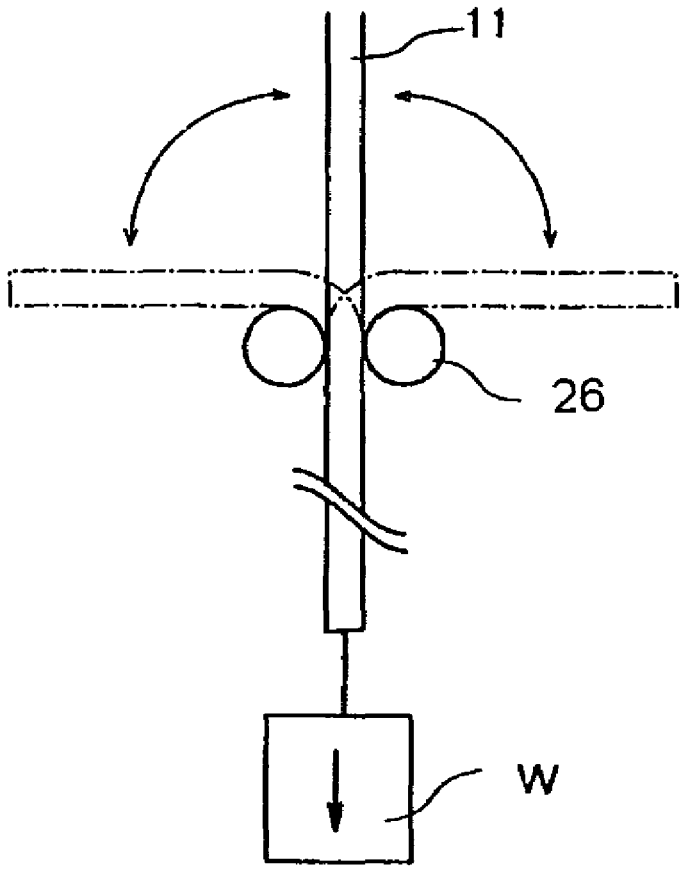
FIG. 4 is a schematic view showing a bending test method.
Figure 5:
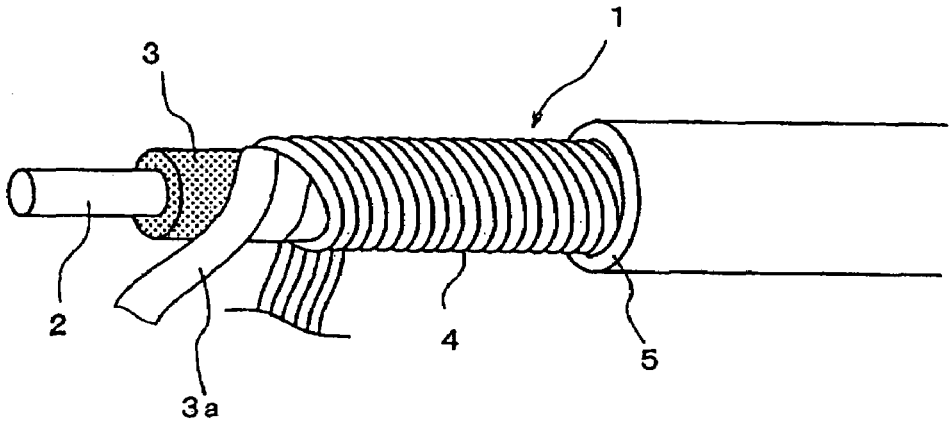
FIG. 5 PRIOR ART
FIG. 5 is a perspective view of one example of a conventional coaxial cable in a state in which the distal end portion of a sheath thereof has been removed.

FIG. 4 is a schematic view showing a bending test method. A bending test was conducted on five coaxial cables of the example and comparative example, respectively, by using the method shown in FIG. 4 and average break cycles at which breakage occurred in the inner conductor of the product of the present invention and the conventional product were calculated. Under condition 1 (bending at a rate of 30 times/min on a mandrel 26 having an outer diameter of 2 mm, a load W of 20 g, and a bending angle of ±90 degrees), the average break cycle regarding the conventional product is 7,419 and the average break cycle regarding the product of the present invention is 21,860, which is about three times the service life of the conventional product. Under condition 2 (bending at a rate of 30 times/min on a mandrel 26 having an outer diameter of 10 mm, a load W of 100 g, and a bending angle of ±90 degrees), the average break cycle regarding the conventional product is 29,521 and the average break cycle regarding the product of the present invention is 76,259, which is about two and a half times the service life of the conventional product.

Figure 6A:
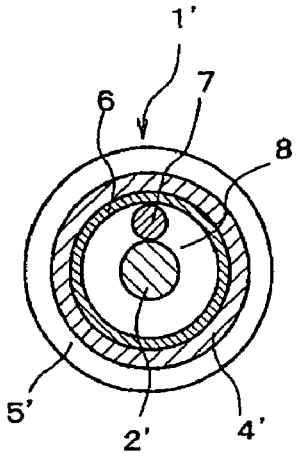
FIG. 6A PRIOR ART
FIG. 6A is a cross sectional view of another example of a conventional coaxial cable taken along a plane perpendicular to the center axis of the cable, the cable having a structure wherein a yarn is wound around the inner conductor.
Figure 6B:
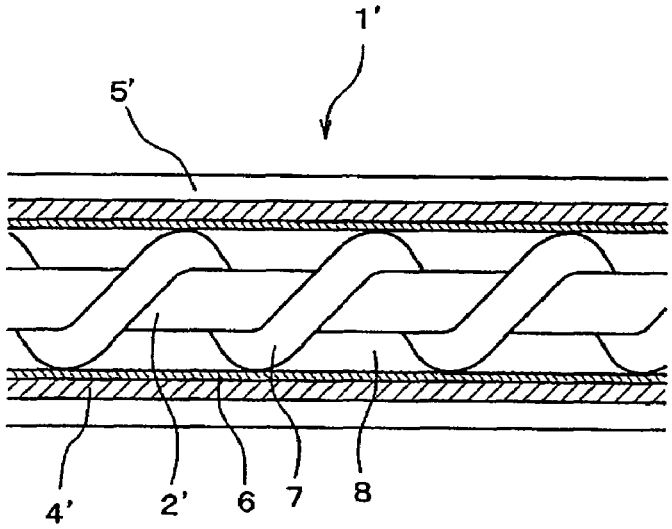
FIG. 6B PRIOR ART
FIG. 6B is a cross sectional view of the cable illustrated in FIG. 6A taken along the center axis of the cable.

It is apparent from the above results that the coaxial cable according to the present invention has excellent bending resistance characteristics and can be used in the bending parts of information-communicating devices, such as wirings that pass through hinges, and cables that are used in medical applications and are bent during handling. The conventional coaxial cable 1' shown in FIGS. 6A and 6B is an example of a conventional product, but the outer diameter of the coaxial cable 1' is 0.45 mm as compared with the 0.38 mm outer diameter of the coaxial cable of an embodiment of the present invention, and the conventional coaxial cable 1' does not satisfy the demand for thinner diameter cables. In addition, pinholes readily form in the insulating tube of the conventional coaxial cable 1'. The conventional coaxial cable 1' therefore has a higher rate of defects and is more difficult to manufacture than the coaxial cable 11 of the present invention.

The entire disclosure of Japanese Patent Application No. 2005-014401 filed on Jan. 21, 2005 is hereby incorporated herein by reference.

The invention claimed is:

1. A coaxial cable, comprising an electrically conductive filament body forming an inner conductor;

a filling yarn made of an electrically insulating resin and twisted together with the inner conductor to form a twisted body;

a tubular insulator having an inner diameter approximately equal to the combined thickness of the inner conductor and the filling yarn, the tubular insulator covering the twisted body and contacting both of the electrically conductive filament body and the filling yarn along the length of the tubular insulator such that air gaps are defined between portions of the tubular insulator and the twisted body to reduce dielectric loss; and an outer conductor provided on an external periphery of the insulator.

2. The coaxial cable of claim 1, wherein the filling yarn and the insulator are made of fluorocarbon resin.

3. A multi-coaxial cable having a plurality of the coaxial cables of claim 1, wherein the coaxial cables are covered by a common sheath made of an insulating material.

4. The multi-coaxial cable of claim 3, wherein the coaxial cables are aligned in a parallel row.

5. The multi-coaxial cable of claim 3, wherein at least one end of the coaxial cables has an electric connection terminal.

6. The coaxial cable of claim 1, further comprising a sheath made of an insulating material and provided on an external periphery of the outer conductor.

7. A multi-coaxial cable having a plurality of the coaxial cables of claim 6, wherein the coaxial cables are covered by a common sheath made of an insulating material.

8. The multi-coaxial cable of claim 6, wherein the coaxial cables are aligned in a parallel row.

9. The multi-coaxial cable of claim 6, wherein at least one end of the coaxial cables has an electric connection terminal.

* * * * *